United States Patent [19]

Segovia

[11] Patent Number: 4,986,550

[45] Date of Patent: Jan. 22, 1991

[54] BROADHEAD ARROW

[76] Inventor: Jose F. Segovia, P.O. Box 2794, Laredo, Tex. 78040

[21] Appl. No.: 511,048

[22] Filed: Apr. 19, 1990

[51] Int. Cl.[5] ..... F42B 6/08

[52] U.S. Cl. ..... 273/422

[58] Field of Search ..... 273/419–422

[56] References Cited

U.S. PATENT DOCUMENTS

| | | | |
|---|---|---|---|
| 3,419,273 | 12/1968 | Rudzinski | 273/421 |
| 3,897,062 | 7/1975 | Christensen | 273/421 |
| 4,036,499 | 7/1977 | Sherwin | 273/422 |
| 4,396,196 | 8/1983 | Drennan | 273/420 |
| 4,537,404 | 8/1985 | Castellano et al. | 273/422 |
| 4,565,377 | 1/1986 | Troncoso, Jr. et al. | 273/422 |

*Primary Examiner*—Paul E. Shapiro

*Attorney, Agent, or Firm*—Richard C. Litman

[57] ABSTRACT

An arrowhead has a flat face which is sharpened around the circular edge and a plurality of staggered blade units. Each blade unit contains two separate blades that are spaced apart down the length of the unit. The blade units are equally spaced about the periphery of the arrowhead. A profile from the front shows that the blades provide a continuous cutting surface in order to maximize bleeding in the target animal. The sharpened flat face is effective in punching a hole through the animal which the rest of the arrow shaft can follow through without frictional resistance.

11 Claims, 2 Drawing Sheets

BROADHEAD ARROW

BACKGROUND OF THE INVENTION

1. Field of the Invention

The present invention relates to arrows used by hunters. More particularly, it relates to a form of arrow known as a broadhead arrow. Arrows of this type are used because of the sizable wounds that they cause in their intended targets. The larger the wound, the quicker the animal will weaken and the easier that it can be chased down by the hunter. The arrowheads are called "broadhead" because of the obvious reason of their appearance, which is quite wide due to the numerous blades on the arrowhead.

2. Description of the Prior Art

Numerous prior arrow designs have been patented, some of which follow below.

U.S. Pat. Nos. 2,874,968 and 3,897,062 issued to Zielinski and Christensen respectively disclose broadhead arrows with an arcuate blade configuration. This blade design allows for more humane kills by forming large cuts in the animal's body to provide rapid bleeding.

Sharrar et. al. U.S. Pat. No. 2,888,264 discloses a broadhead arrow design capable of cutting a large open wound in game. The broadhead includes a peripheral ring formed in the shape of a circle, triangle or square. This ring is the main element in cutting the large open wound.

Savora U.S. Pat. No. 3,915,455 discloses a broadhead arrow tip with removable and interchangeable points and blades.

Kosbab U.S. Pat. No. 4,210,330 discloses a modular broadhead arrow tip with a plurality of interchangeable points and blades.

Bateman, III U.S. Pat. No. 4,254,958 discloses an arrowhead with dual blades formed in the sam slot of the arrowhead's base.

None of the above prior arrowhead designs gives a multi-stage bladed broadhead. The advantage of dividing up the multiple blades into various stage is that each separate stage can be replaced. The profile of all the blades from the front of the arrow will yield an overlapping profile, allowing a continuous wound to be cut into the animal, therefore giving a fast rate of bleeding.

SUMMARY OF THE INVENTION

Accordingly, it is an object of the present invention to provide a multi-stage bladed broadhead arrow.

It is one object of the present invention to provide a multi-stage bladed broadhead arrow having blade units that have multiple blades.

It is another object of the present invention to provide a multi-stage bladed broadhead arrow having blade units that are staggered along the length of the arrowhead.

It is an additional object of the present invention to provide a multi-stage bladed broadhead arrow having blade units that have intersecting blade profiles.

These and other objects of the present invention will become readily apparent upon further review of the following specification and drawings.

BRIEF DESCRIPTION OF THE DRAWINGS

Similar reference characters denote corresponding features consistently throughout the attached drawings.

A DETAILED DESCRIPTION OF THE PREFERRED EMBODIMENT

Figure 1A:
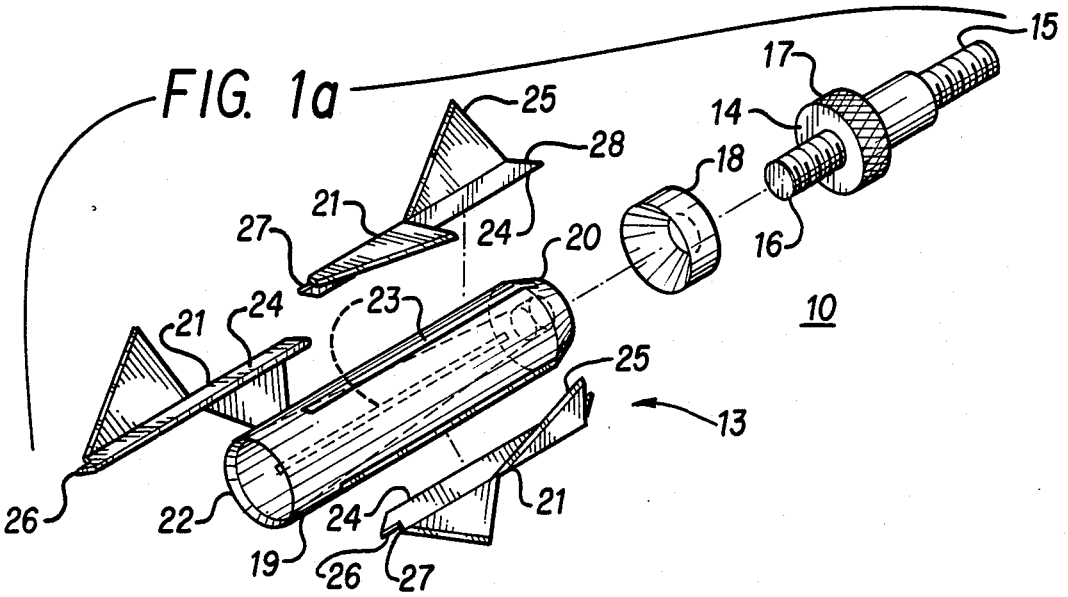
FIG. 1*a* shows an exploded perspective view of one embodiment of the present invention.
Figure 1B:
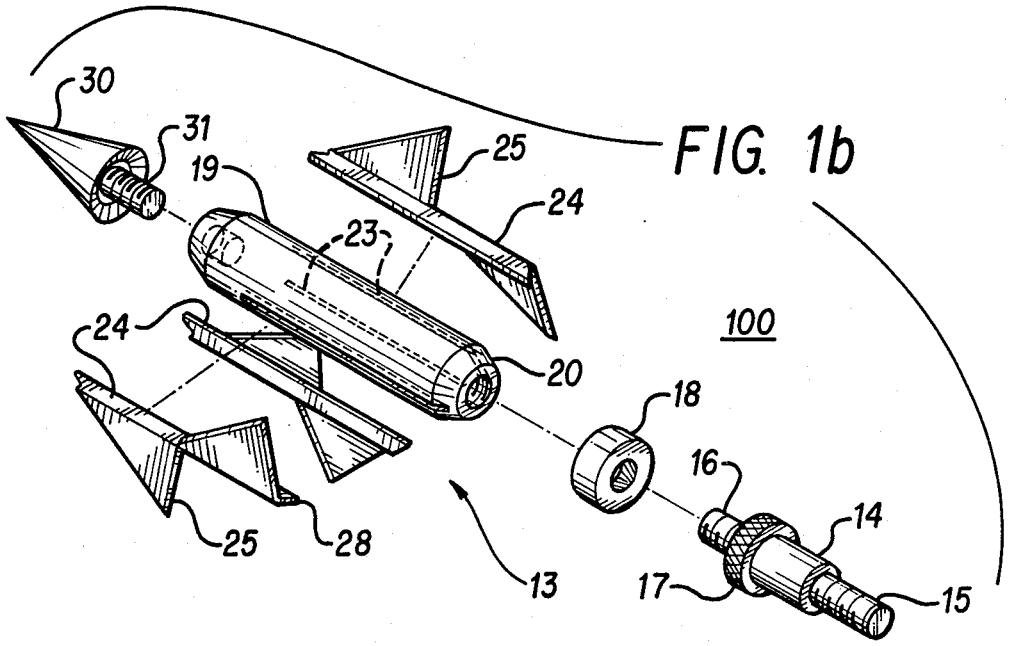
FIG. 1*b* shows an exploded perspective view of an alternate embodiment of the present invention.
Figure 2A:
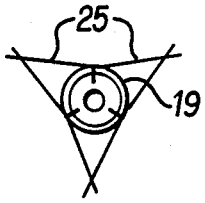
FIGS. 2*a*–2*c* show front views of the present invention with various blade configurations .
Figure 2B:
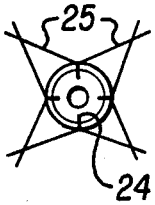
Figure 2C:
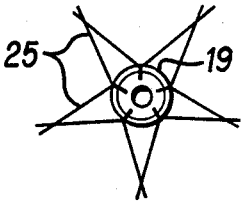

The present invention 10 of a multi-stage bladed broadhead arrow is shown in an exploded form detailing the individual components in FIG. 1*a*. It comprises an elongated shaft 11 that can be made of wood, Fiberglas, or carbon composites, all materials which are used in the making of arrow shafts 11. The rear end of the shaft has the conventional flight feathers that are found on hunting arrows. The arrowhead 13 is found at the other end of the shaft 11. A two ended connector 14 has two sets of screw threads 15, 16. One set of threads 15 connects the connector 14 with the end of the arrow shaft 11. The shaft 11 has reciprocal internal threads to mate with threads 15. The other set of threads 16 connect with the arrowhead 13.

The connector has knurling 17 to allow the connector to be grasped as it is being screwed into the arrowhead 13. A washer unit 18 serves as a buffer between the connector 14 and the arrowhead body 19. The end of arrowhead body 20 is tapered to fit snugly within a reciprocal tapering within the washer 18. This washer also serves to lock in the blade units 21 as will be described.

The arrowhead body 19 consists of an elongated tube made out of high strength Carbon Steel. The end 22 of the tube 19 opposite the shaft 11 forms a circle having a sharpened edge. This is the initial edge that enters the animal. It punches a hole of the same diameter as the end 22 enters the animal and thereby prevents the friction that would be caused by the remainder of the shaft 11 rubbing against the initial entry point. By preventing the frictional loss caused by the arrow shaft 11 rubbing against the entry wound, the penetration of the arrowhead 13 is greater. Disposed parallel in a lengthwise fashion along the arrowhead body 19 are a series of slots 23. These slots are spaced about the periphery of the arrowhead body 19 in an equi-angular manner, if there are three slots, they are spaced 120° apart. These slots 23 serve to hold the blade units 21 for the arrowhead 13. The slots 23 extend to the tapered portion 20 of the arrowhead body 19. When the washer 18 covers this portion of the slots 23, it locks in the blade units 21.

Figure 3A:
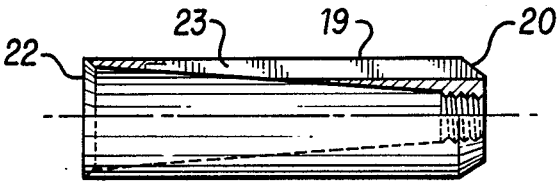
FIG. 3*a* shows a side view in cross-section of one embodiment of the present invention.
Figure 3B:
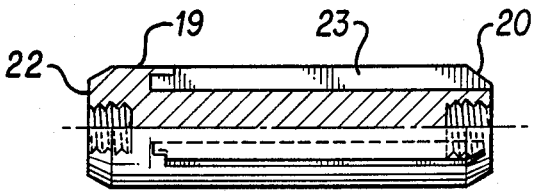
FIG. 3*b* shows a side view in cross-section of an alternate embodiment of the present invention.
Figure 4A:
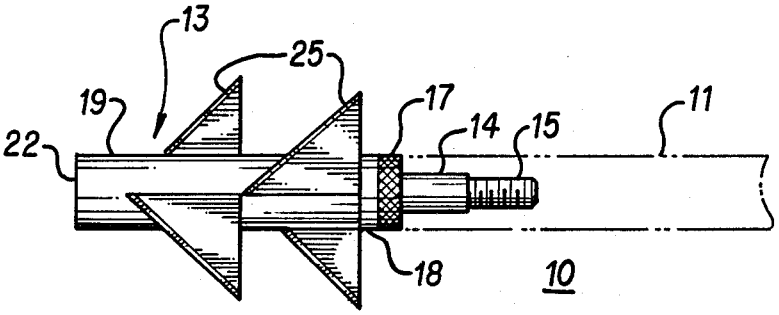
FIG. 4*a* shows a side view of one embodiment of the present invention.
Figure 4B:
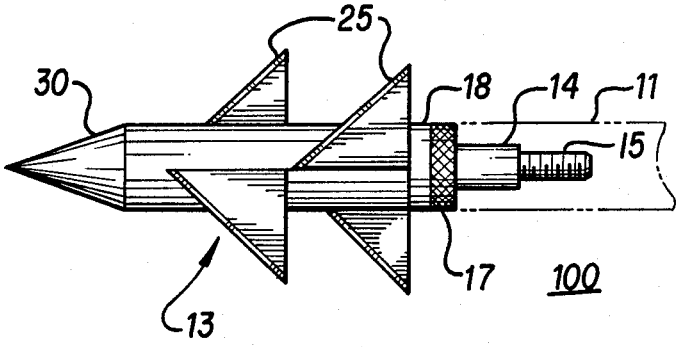
FIG. 4*b* shows a side view of an alternate embodiment of the present invention.

The blade units 21 comprise a central flange 24 from which a plurality of sharpened blades 25 extend. The flange 24 fits within the slot 23 on the arrowhead body 19. One end 26 of the flange 24 has a notch 27 that engages the arrowhead body 19 beneath the slot 23 as can be seen in FIGS. 3*a* and 3*b*. The other end 28 of the flange 24 is tapered to fit with the tapered end 20 of the arrowhead body 19 so that when the washer 18 goes over the tapered end 20 of arrowhead body 19 it locks the blade unit 21 in place. The blades 25 are staggered in their arrangement on the flange 24. This gives a multi-stage cutting effect as the arrow goes into the animal. As seen from the front in FIGS. *2a, 2b, 2c,* the blades 25 all overlap in profile to give a continuous cutting pattern.

As can be seen from FIG. *2a* with the three slot variation, the blades 25 have an angle between them of approximately 150°. This angle can be increased or decreased to alter the surface area of the cutout section that the arrowhead 13 makes as it enters the animal. This will in turn affect the bleeding rate of the animal. If the angle between the blades is decreased, the blade length will have to be increased in order to make a continuous cut pattern. Blades that are too long can be unwieldy and easily damaged. Likewise, if the angle is increased, the total surface area of the cutout pattern will decrease and therefore lower the bleeding rate of the animal. A happy medium is approximately 150° between the blades 25 for an arrowhead that uses three equally spaced blade units 21. With an additional number of blade units 21, the angle will have to be adjusted for optimum performance, as shown in FIGS. *2b* and *2c*.

An alternative version 100 of the present invention is presented in FIG. *1b*. The difference lies mainly in that the arrowhead body 19 is solid as shown in FIG. *3b* and with the end 22 of the arrowhead body 19. Instead of having a circular edge, a nosecone or tip 30 is fitted onto the end 22. Screwthreads 31 mate with reciprocal threads in the end 22 of the arrowhead body 19. This allow the arrowhead 13 to have a more conventional tip. Such a conventional tip is better suited for long distance shots since it is more streamlined than the flat face 22 of the previous embodiment 10. The flat faced variant 10 of the arrowhead would be most effective for close range shots where a high velocity would assist in punching through the animal's hide.

It is to be understood that the present invention is not limited to the sole embodiment described above, but encompasses any and all embodiments within the scope of the following claims.

I claim:

1. A multi-stage bladed broadhead arrow including:

an elongated shaft;

an arrowhead attached to one end of said elongated shaft, including, a hollow tubular body portion, a plurality of longitudinal slots disposed about the periphery of said hollow tubular body portion, blades extending outwardly from said slots, and said hollow tubular body portion having a flat faced edge distal said elongated shaft with said flat faced edge being sharpened.

2. The multi-stage bladed broadhead arrow according to claim 1, wherein:

said blades are comprised of separate blade units disposed in each separate slot, each blade unit having a plurality of individual blades disposed along the length of said slot.

3. The multi-stage bladed broadhead arrow according to claim 2, wherein:

said individual blades on each blade unit are disposed in a non-coplanar manner in relation to each other.

4. The multi-stage bladed broadhead arrow according to claim 3, wherein:

the forward facing outline of said individual blades forms a continuous intersecting cutting pattern.

5. The multi-stage bladed broadhead arrow according to claim 2, wherein:

two individual blades are disposed on each separate blade unit.

6. The multi-stage bladed broadhead arrow according to claim 5, wherein:

said individual blades on each said blade unit are disposed at an angle of between 120° and 180° relative to one another.

7. A multi-stage bladed broadhead arrow including:

an elongated shaft;

an arrowhead attached to one end of said elongated shaft, including a cylindrical body portion having a front end and rear end, said rear end joining to said elongated shaft;

a conical tip attached to said front end to provide a point for said arrow;

a plurality of planar blades, said blades further comprising a front band of blades encircling said body portion proximal said front end, and a rear band of blades encircling said body portion distal said front end, each of said blades defining a blade plane, each one of said blade planes defined by one of said blades of said front bend, together with another one of said blade planes defined by one of said blades of said rear band, forming a pair of intersecting blade planes, said intersecting blade planes adapted together with said blades to provide overlapping cuts, whereby as the arrowhead penetrates a target the front band of blades initially makes a series of cuts, and the rear band of blades sequentially makes another series of cuts, the cuts overlapping to define an aperture through the target.

8. A multi-stage bladed arrowhead as in claim 7 wherein said conical tip is removable.

9. A multi-stage bladed broadhead arrow as in claim 7 wherein each of said blades is generally triangular in outline, each having an apex distal said body portion, and including a straight joining edge fastened to said body portion along a line colinear with the axis of said body portion;

said blades having a width from said body portion to each said apex;

said blades having the joining edge of each one of said blades of said front band colinear with the joining edge of another one of said blades of said rear band, the joining edges of said blades defining in space a right prism, said prism in cross section an equilateral equiangular polyhedron, said prism coinciding with and inscribing a portion of said cylindrical body portion of said arrowhead, the joining edge of each one of said blades partially defining a radial plane, each said radial plane defined by the joining edge of said one blade and the axis of said cylindrical body portion;

each one of said blades inclined at an angle to its respective one said radial plane, each one of said blades of said front band inclined in a first sense of rotation to said one radial plane, and each one of said blades of said rear band inclined in a second sense of rotation to said one radial plane; and said width and said angle together adapted to provide overlapping cuts by pairs of blades, said pairs each including one blade of said front band and one blade of said rear band, whereby as the arrowhead penetrates a target the cuts of the front band of blades and the cuts of the rear band of blades overlap to define a generally star-shaped aperture through the target.

10. An arrow as in claim 9 including slots in said body portion wherein said blades are removably fastened.

11. An arrow as in claim 10 wherein the colinear joining edges of one of said front blades and the corresponding one of said rear blades attach to a flange to provide a blade unit, said flange insertable into one of said slots; whereby said front and rear blades may be removably mounted to said body portion in pairs.

* * * * *